US007188601B1

(12) United States Patent
Trease

(10) Patent No.: US 7,188,601 B1
(45) Date of Patent: Mar. 13, 2007

(54) OIL PUMP FOR ENGINE USING GEROTORS HAVING FULLY FILTERED OIL FLOW

(75) Inventor: John Trease, Melbourne (AU)

(73) Assignee: Renegade Motors International Pty Ltd., Gold Coast (AU)

( * ) Notice: Subject to any disclaimer, the term of this patent is extended or adjusted under 35 U.S.C. 154(b) by 0 days.

(21) Appl. No.: 11/296,295

(22) Filed: Dec. 8, 2005

(51) Int. Cl.
*F02B 67/04* (2006.01)

(52) U.S. Cl. ..... 123/198 C; 123/196 R

(58) Field of Classification Search ..... 123/512, 123/198 C, 196 R; 418/171, 39, 182, 200; 184/6.5
See application file for complete search history.

(56) References Cited

U.S. PATENT DOCUMENTS 3,572,983 A 3/1971 McDermott
4,545,748 A 10/1985 Middlekauff
4,703,724 A * 11/1987 Candea et al. ..... 123/192.2
4,756,066 A * 7/1988 Scharlacken et al. .. 29/888.023
4,824,347 A 4/1989 Diugokecki
4,976,595 A * 12/1990 Taniguchi ..... 418/171
5,085,187 A * 2/1992 Black ..... 123/196 R
5,215,165 A * 6/1993 Torii ..... 184/31
5,983,849 A * 11/1999 Wangen et al. ..... 123/90.61
6,047,667 A * 4/2000 Leppanen et al. ..... 123/196 R
6,176,211 B1 * 1/2001 Tanaka et al. ..... 123/90.61
6,244,239 B1 * 6/2001 Sisco et al. ..... 123/198 R
6,295,959 B1 * 10/2001 Molina et al. ..... 123/90.31
6,419,469 B1 * 7/2002 Shulver et al. ..... 418/15
6,460,504 B1 * 10/2002 Phillips et al. ..... 123/196 R
6,679,692 B1 * 1/2004 Feuling ..... 418/171
6,729,855 B2 5/2004 Havlik et al.
7,037,088 B2 * 5/2006 Shulver et al. ..... 417/364

* cited by examiner

*Primary Examiner*—Stephen K. Cronin
*Assistant Examiner*—Ka Chun Leung
(74) *Attorney, Agent, or Firm*—Hoffman, Wasson & Gitler, P.C.

(57) ABSTRACT

The oil pump has a cam support plate attached to the engine block. The support plate has a pressure relief valve. An oil pump body assembly has a pair of gerotors on each side. The gerotors are attached to and driven by a shaft attached to the rear cam.

14 Claims, 4 Drawing Sheets

OIL PUMP FOR ENGINE USING GEROTORS HAVING FULLY FILTERED OIL FLOW

BACKGROUND OF THE INVENTION

Four stroke internal combustion engines need a supply of oil to the pistons, valves and other moving parts in order to maintain smooth function of the engine. A supply of oil is maintained in an oil pan and an oil pump provides pressure to supply oil through oil channels to the necessary moving parts. Supplying the correct volume and pressure of oil to the moving parts of an engine is critical.

Providing an oil pump with a minimum of moving parts and the ability to operate over a long period of time is the goal of designing an oil pump. Many different designs for oil pumps have been developed over the years. An example of one oil pump is disclosed in U.S. Pat. No. 6,729,855 (Havlik et al). A pump body includes a first gear chamber and a second gear chamber, each housing a set of intermeshing involute spur gears. The gears are driven by a drive shaft. The pump body has both a check valve assembly and a pressure release valve. Passages direct oil to lifters, push rods, rocker arms, valve guides and piston oilers.

It is an object of the invention to provide an oil pump for an engine having a minimum of moving parts by providing a satisfactory volume and pressure of oil to the engine.

It is another object of the invention to provide an oil pump using gerotors to pump oil.

It is another object of the invention to provide an oil pump driven by a shaft connected to a cam shaft of the engine.

These and other objects of the invention will be apparent from one of ordinary skill in the art after reading the disclosure of the invention.

SUMMARY OF THE INVENTION

The oil pump has a cam support plate attached to the engine block. The support plate has a pressure relief valve. An oil pump body assembly has a pair of gerotors on each side. The gerotors are attached to and driven by a shaft attached to the rear cam.

Gerotors are a positive displacement pump mechanism providing a predetermined quantity of fluid in proportion to the speed at which they rotate. Gerotors are used in hydraulic systems such as those disclosed in U.S. Pat. No. 4,545,748 to Middlecauff and U.S. Pat. No. 4,824,347 to Dlugokecki and U.S. Pat. No. 3,572,983 to McDermott. A gerotor is often made of a three piece package having an inner and outer gerotor and an eccentric locator ring. The outer gerotor also serves as a pump housing. A gerotor is a self-priming positive displacement valveless mechanism which handles impurities well. Gerotor elements revolve in the same direction with low relative speed since the inner gerotor advances one tooth space per revolution. As an example, it is possible to have a gerotor running at 1800 rpm but having an inner and outer gerotor revolving at only 200 rpm with respect to each other. This relatively low speed minimizes tooth wear and provides high function with high volumetric efficiency.

DETAILED DESCRIPTION OF THE INVENTION

Figure 1:
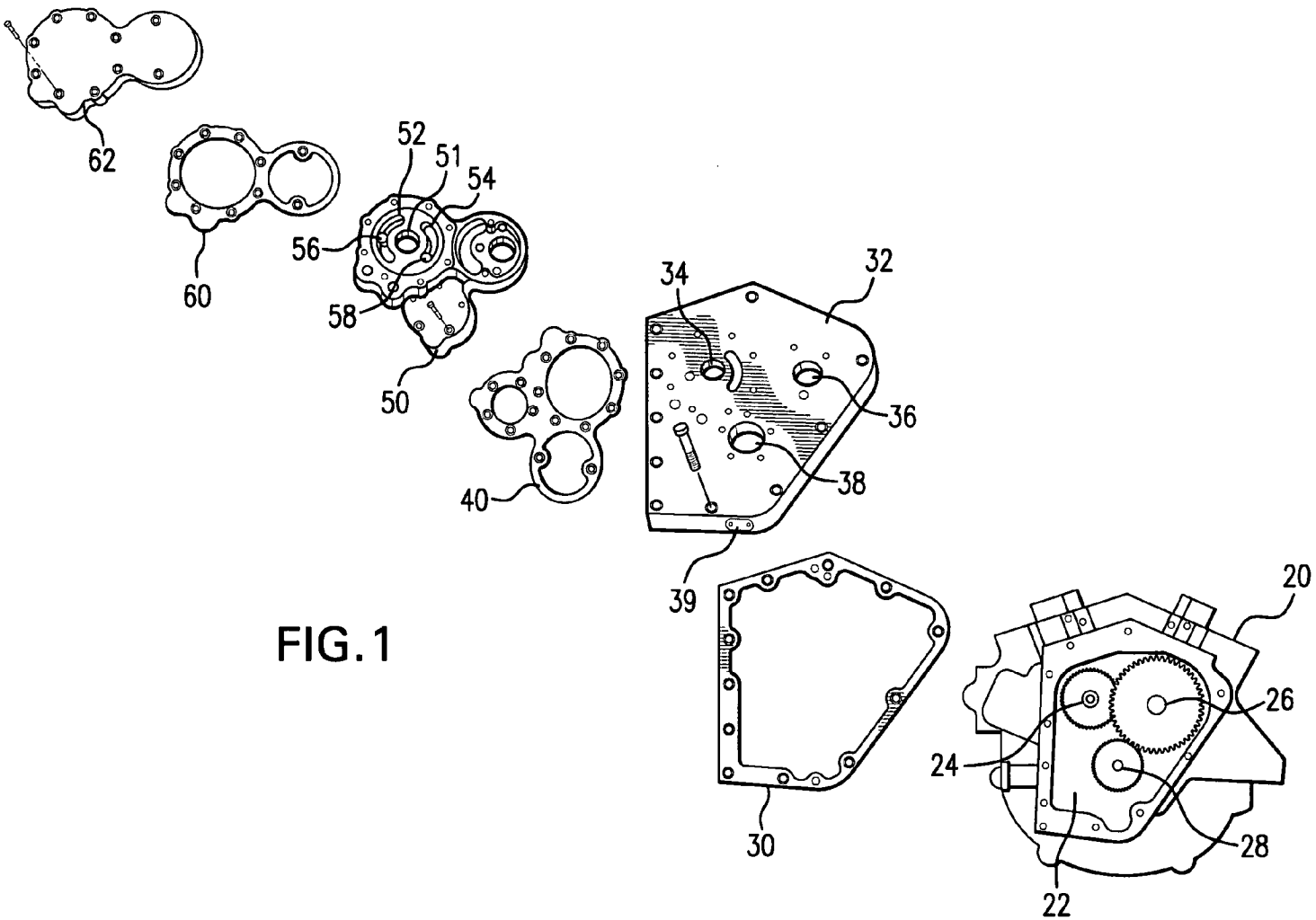
FIG. 1 is an exploded view of the oil pump.

An exploded view of the oil pump with the moving parts deleted for clarity is seen in FIG. 1. The engine 20 has a cam chest 22. Within the cam chest 22 is a rear cam shaft 24, a front cam shaft 26 and a crank shaft 28.

A cam support plate 32 connects to the engine 20 with a gasket 30 between the plate and engine. The cam support plate has a first aperture 34, a second aperture 36 and a third aperture 38. Also seen is the pressure relief valve 39, which will be explained more fully later. A gasket 40 separates the cam support plate 32 from the oil pump body 50. The gasket 40 and oil pump body 50 each have three lobes. The oil pump body 50 has an aperture 51 aligning with the aperture 34 in the cam support plate. On either side of the aperture 51 is an arcuate oil galley 52, 54. Within the galley 52 is aperture 56 extending through the oil pump body. Likewise, the second oil galley 54 has aperture 58 extending through the oil pump body. The galleys are within a recess having a depth and diameter to accommodate a gerotor. The opposite side of the oil pump body has a similar recess for receiving a second gerotor. Alternatively, the recesses for the gerotors can be formed in the cam support plate 32 and cover 62.

A cover 62 and gasket 60 are secured to the oil pump body to complete the enclosure. As is seen, screws or other conventional fasteners extend through apertures in the cover 62, gasket 60, oil pump body 50 and gasket 40 and are secured into the cam support plate 32 to secure all parts together.

Figure 2:
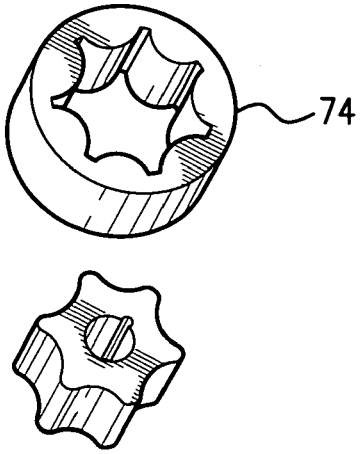
FIG. 2 are views of the front and rear gerotor.
Figure 2:
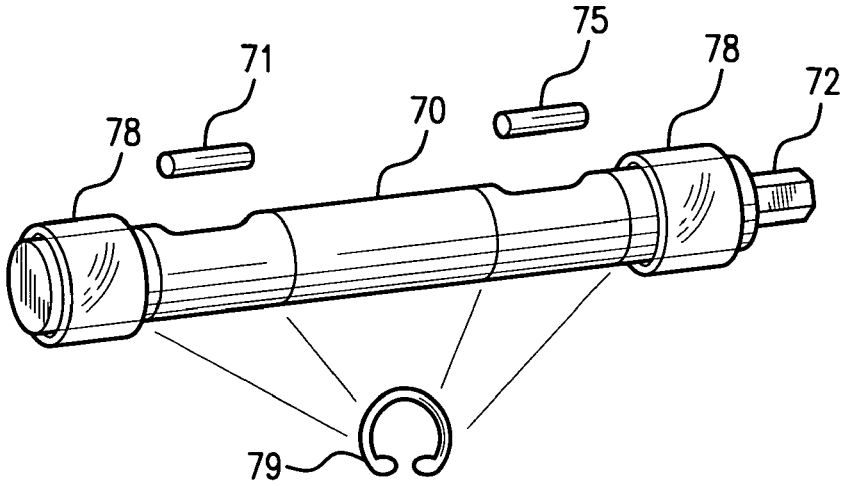
Figure 2:
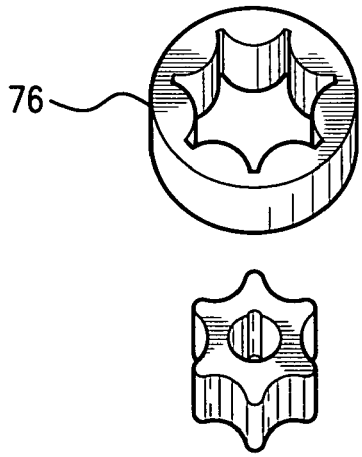

FIG. 2 shows the drive shaft and gerotors used with the oil pump. The end of the drive shaft 70 has a hex end 72. Spaced inwardly from the ends of the drive shaft 70 are a pair of bushings 78. Front gerotor 74 and rear gerotor 76 are mounted onto the drive shaft interiorly of the bushings. As is the case with gerotors, the inner member has one less tooth than the outer member. The gerotors are fixed to the drive shaft in any conventional manner. One possible method is to provide the drive shaft with a groove into which a dowel 75 is placed. The dowel fits within a notch in the inner member of each gerotor and acts as a key to prevent relative rotation between the drive shaft 70 and the inner part of the gerotor. Retaining rings 79 on either side of the gerotor serve to keep the gerotor for moving axially along the drive shaft.

Figure 3:
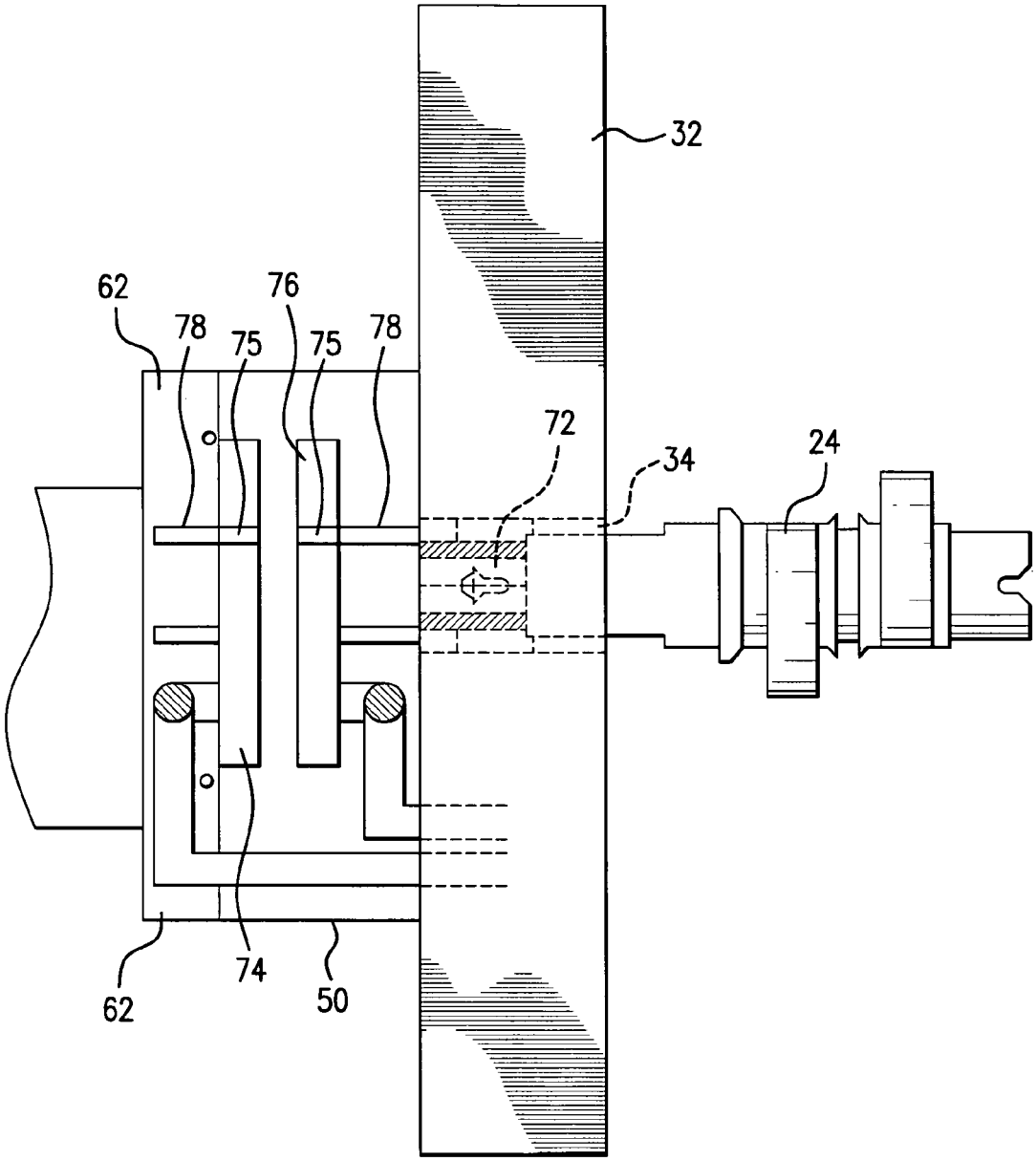
FIG. 3 is a side cross-sectional view of the oil pump.

FIG. 3 is a side cross-sectional view of the oil pump. As can be seen, the rear cam 24 extends into the aperture 34 in cam support plate 32. The hex end 72 of the drive shaft 70 connects to the rear cam so that rotation of the rear cam drives the drive shaft. Any conventional method of connecting the drive shaft 72 to the rear cam shaft may be used with the invention, including making the drive shaft an integrally formed extension of the cam shaft. Bushings 78 are seen as is the front gerotor 74 and rear gerotor 76, all housed within the oil pump body assembly 50. Formed within the oil pump body assembly are oil lines to carry oil to and from the gerotors.

Figure 4:
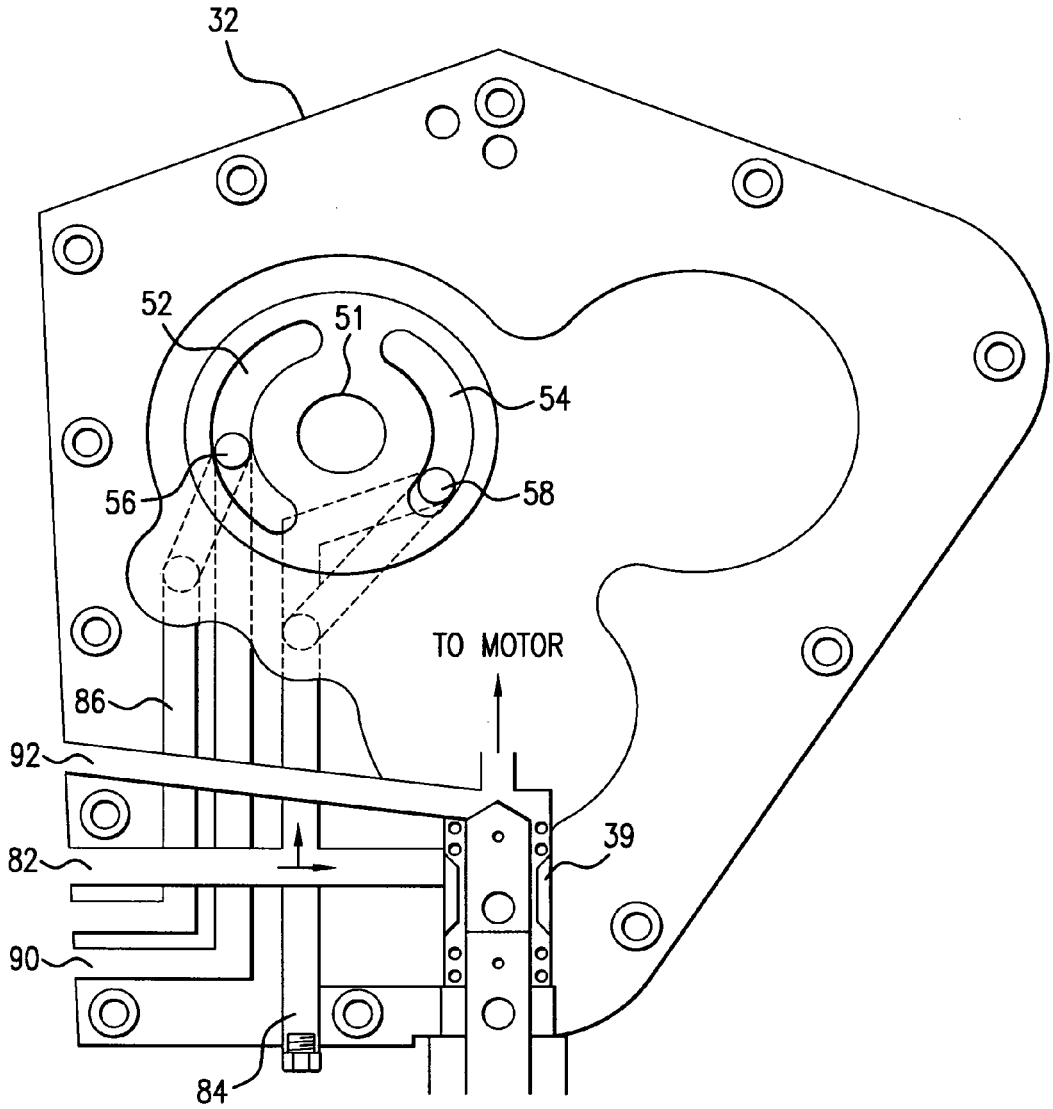
FIG. 4 is a schematic view of the cam support plate, oil pump housing and oil lines.

The oil lines are more clearly seen with reference to FIG. 4. The oil lines within the cam support plate 32 are depicted in FIG. 4. A first line 82 extends from the tank. This line is branched with a first branch extending to the pressure relief valve 39 and a second branch extending upwardly toward the oil pump body. A drain 84 extends downwardly from the oil pump body. After oil travels through the front and rear gerotors of the pump, oil exits through one of two lines. The first line 86 leads to a filter whereas the second line 90 is a scavenging return. The oil passes through the filter before going to the moving parts, creating a fully filtered flow. Oil returning from the filter extends along line 92 which extends pass pressure relief valve 39. If the pressure exceeds the set pressure, most likely 65 lbs., the pressure valve will open to relieve the pressure. When the pressure relief valve is closed, oil extends upwardly into the motor to supply lubrication to all parts of the motor.

While the invention has been described with reference to a preferred embodiment, variations and modifications would be apparent to one of ordinary skill in the art without departing from the spirit of the invention.

What is claimed is:

1. An engine comprising
an engine block having a cam chest,
at least one cam shaft within said cam chest,
a cam support plate attached to said engine block,
an aperture in said cam support plate receiving said at least one cam shaft,
an oil pump body attached to said cam support plate, said oil pump body having a left side and a right side,
an aperture in said oil pump body aligned with said cam support plate aperture,
a drive shaft connected to said at least one cam shaft extending through said oil pump body aperture,
a first gerotor mounted on said drive shaft and on said left side of said oil pump body.

2. The engine of claim 1, further comprising
a second gerotor mounted on said drive shaft and on said right side of said oil pump body.

3. The engine of claim 2, further comprising
a first recess in said left side of said oil pump body,
said first gerotor lying in said first recess, and
at least one oil passageway in said oil pump body extending through said oil pump body,
a second recess in said right side of said oil pump body,
said second gerotor lying in said second recess.

4. The engine of claim 3, wherein said oil pump body has two oil passages.

5. The engine of claim 1, further comprising
a cover attached to said oil pump body.

6. The engine of claim 1, wherein
said first gerotor has an inner member and an outer member,
a notch in said inner member,
a groove in said drive shaft, and
a dowel in said notch and groove to secure said gerotor to said drive shaft.

7. The engine of claim 6, further comprising
a pair of retaining clips on either side of said first gerotor engaging said drive shaft.

8. An oil pump comprising
a cam support plate,
an aperture in said cam support plate,
an oil pump body attached to said cam support plate, said oil pump body having a left side and a right side,
an aperture in said oil pump body aligned with said cam support plate aperture,
a drive shaft extending through said oil pump body aperture,
a first gerotor and a second gerotor mounted on said drive shaft, the oil pump body being between the first and second gerotor.

9. The oil pump of claim 8 further comprising
a first recess in said left side of said oil pump body,
said first gerotor lying in said first recess, and
at least one oil passageway in said oil pump body extending through said oil pump body,
a second recess in said right side of said oil pump body,
said second gerotor lying in said second recess.

10. The oil pump of claim 9, wherein said oil pump body has two oil passages.

11. The oil pump of claim 8, further comprising
a cover attached to said oil pump body.

12. The oil pump of claim 8, wherein
said first gerotor has an inner member and an outer member,
a notch in said inner member,
a groove in said drive shaft, and
a dowel in said notch and groove to secure said gerotor to said drive shaft.

13. The oil pump of claim 12, further comprising
a pair of retaining clips on either side of said first gerotor engaging said drive shaft.

14. The engine of claim 1, wherein said drive shaft has a hex end, said hex end engaging said at least one camshaft.

* * * * *